United States Patent [19]

Szymanek

[11] Patent Number: 4,772,216

[45] Date of Patent: Sep. 20, 1988

[54] LIGHT FIXTURE WITH REVERSIBLE MOUNTING END CAPS

[75] Inventor: Donald D. Szymanek, Westlake, Calif.

[73] Assignee: Thin-Lite Corporation, Camarillo, Calif.

[21] Appl. No.: 14,023

[22] Filed: Feb. 12, 1987

[51] Int. Cl.[4] ..... H01R 13/74

[52] U.S. Cl. ..... 439/234; 362/217; 439/569

[58] Field of Search ..... 439/226, 234, 239–241, 439/207, 211, 527, 532, 541, 542, 562–565, 569, 570; 362/217, 260, 368

[56] References Cited

U.S. PATENT DOCUMENTS

| | | | |
|---|---|---|---|
| 2,134,170 | 10/1938 | Brown | 439/242 |
| 2,596,056 | 5/1952 | Tinnerman | 439/240 |
| 2,724,047 | 11/1955 | Zurawski | 362/260 |
| 2,982,850 | 5/1961 | Lister et al. | 439/234 |
| 3,328,578 | 6/1967 | Gough | 362/217 |
| 3,337,837 | 8/1967 | Pistey | 439/241 |
| 3,401,242 | 9/1968 | McLaughlin | 200/51.07 |
| 3,654,587 | 4/1972 | McLaughlin | 439/241 |
| 3,681,594 | 8/1972 | Johnson | 439/240 |
| 3,975,073 | 8/1976 | McLaughlin | 439/241 |
| 4,124,267 | 11/1978 | Mines et al. | 248/27.3 |
| 4,130,860 | 12/1978 | Careglio et al. | 362/217 |
| 4,198,109 | 4/1980 | Ustin | 439/239 |
| 4,208,702 | 6/1980 | Wotowiec | 362/217 |

FOREIGN PATENT DOCUMENTS

| | | | |
|---|---|---|---|
| 272948 | 3/1966 | Australia | 362/217 |
| 467284 | 10/1974 | Australia | 362/217 |
| 657362 | 6/1965 | Belgium | 362/217 |
| 1400089 | 4/1965 | France | 362/217 |

*Primary Examiner*—Gil Weidenfeld
*Assistant Examiner*—Gary F. Paumen
*Attorney, Agent, or Firm*—Fulwider, Patton, Rieber, Lee & Utecht

[57] ABSTRACT

A light fixture including a channel-shape open ended housing having a top wall and opposed walls. End caps are provided for the housing, each including an end plate with a pair of longitudinally extending tabs spaced laterally apart and formed on their proximate edges with longtiudinal tongues. The caps are reversible such that in one mounted position the tabs project longitudinally outwardly from the housing for acting as mounting tabs when the housing is to be recessed upwardly in the overhead for flush mounting. The caps may be reversed on the ends of the housing to dispose the tabs within the housing itself. In this configuration a pair of lamp sockets may be mounted directly from the tabs. The lamp sockets are formed on their opposite sides with longitudinal grooves into which such tongues are received in a friction fit arrangement to be held in position.

6 Claims, 1 Drawing Sheet

LIGHT FIXTURE WITH REVERSIBLE MOUNTING END CAPS

BACKGROUND OF THE INVENTION

1. Field of the Invention

The present invention relates to a light fixture for fluorescent tubes.

2. Description of the Prior Art

The advantage of fluorescent lights have long been known and their popularity continues to grow particularly in the recreational vehicle industry. The advantages have led to wide acceptance for use in, for instance, motor homes and boats.

Since recreational vehicles are of many different configurations, it is important that light fixtures have wide mounting versatility. For instance, in come applications it is necessary or desirable to mount the light fixtures from the overhead or ceiling in such a manner than the fixtures themselves project from the ceiling. In other applications, it is desirable to recess such fixtures within the ceiling itself in what is often termed a flush mounting configuration.

Fluorescent light fixtures typically incorporate a pair of electrically insulated end sockets which are mounted from the housing in one configuration or another depending on whether or not the fixture is to be flush mounted. A light socket of this type is shown in U.S. Pat. No. 4,198,109 issued to Ustin. Manufacturers must meet certain safety codes in the manufacture, fabrication, assembly and shipping of these light fixtures. The light sockets themselves are typically constructed of somewhat fragile material thus subjecting them to breakage during shipping and handling. Consequently, there is a need for a light fixture which has capability of being converted to various mounting configurations and wherein the light sockets are protected within the confines of the fixture itself during initial shipping and handling. Often times light fixtures are added by the owner after initial acquisition of the recreational vehicle so it is important that assembly be relatively straightforward and safe.

SUMMARY OF THE INVENTION

The present invention is characterized by an elongated, channel-shaped light housing open on its opposite ends for receipt thereon of respective reversible end caps. The end caps are in the form of end plates having laterally spaced apart mounting tabs projecting longitudinally therefrom. The end caps may be reversed such that the tabs project either longitudinally outwardly of the housing or longitudinally into the housing. With the tabs in their exposed configuration, the housing itself may be recessed into, for instance, an opening in the ceiling and the tabs utilized as mounting tabs to secure the fixture to such ceiling.

The tabs are formed on their proximate sides with longitudinal tongues which, with the end caps reversed and tabs projecting inwardly into the housing, may be received in grooves formed in the opposite sides of the bases of respective lamp sockets such that the lamp sockets may be mounted therefrom to project bodily from the housing itself for receipt therebetween of the fluorescent tube.

Other objects and features of the invention will become apparent from consideration of the following description taken in connection with the accompanying drawing.

DESCRIPTION OF THE PREFERRED EMBODIMENT

Figure 3:
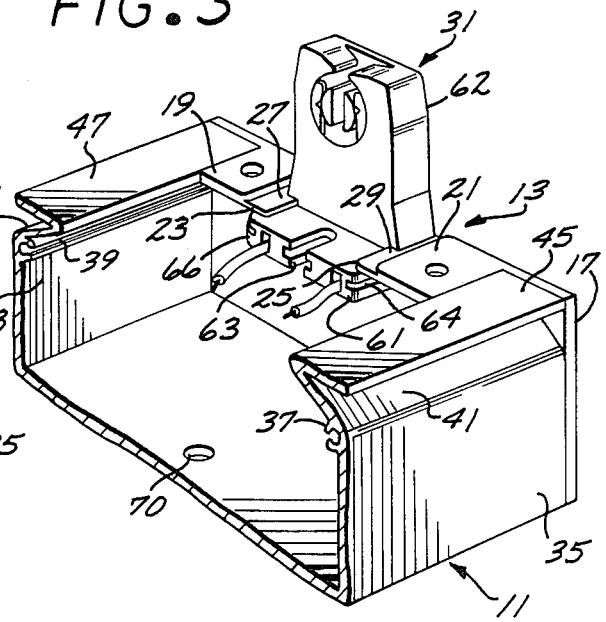
FIG. 3 is a broken perspective view, in enlarged scale, of the light fixture shown in FIG. 1.
Figure 4:
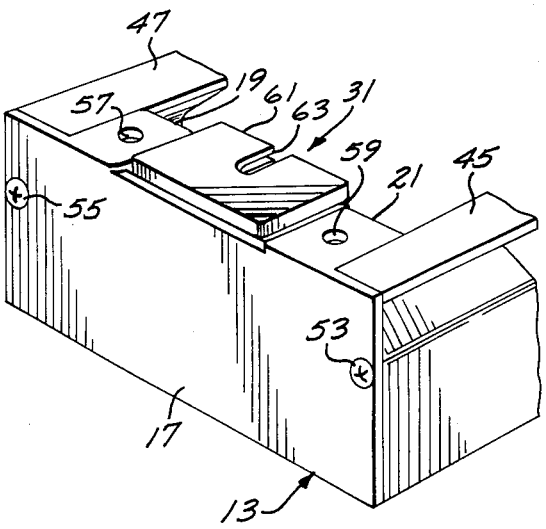
FIG. 4 is a partial perspective view, in enlarged scale, of the righthand end of the light fixture shown in FIG. 1.

Referring to FIGS. 3 and 4, the light fixture of the present invention includes, generally, a channel-shaped housing 11 which is open on its opposite ends for receipt for respective end caps 13 and 15. Each end cap includes an end plate 17 having laterally spaced apart longitudinal tabs 19 and 21 projecting from the bottom side thereof. The proximate sides of the tabs 19 and 21 are formed with respective confronting tongues 23 and 25 which are selectively receivable in respective grooves 27 and 29 formed in the opposite sides of a light socket, generally designated 31. Thus, the end caps 13 and 15 may be mounted from the housing 11 with the tabs 19 and 21 projecting inwardly as shown in FIG. 3 for receipt over the respective ribs 23 and 25 of the grooves 27 and 29 for mounting in the socket 31. In the alternative arrangement, the tabs 19 and 21 project longitudinally outwardly as shown in FIG. 5 to act as mounting tabs for mounting the fixture flush to the ceiling.

Figure 2:
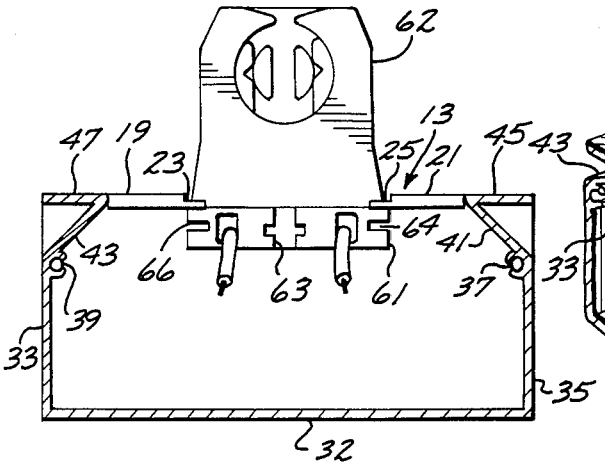
FIG. 2 is a transverse sectional view, in enlarged scale, taken along the line 2—2 of FIG. 1.

Referring to FIG. 2, the housing 11 is generally channel-shaped and may be constructed of, for instance, extruded aluminum to form a top wall 31 and a pair of opposed side walls 33 and 35. The side walls 33 and 35 project from the opposite sides of the back wall and are formed medially on their interiors with longitudinal semi-cylindrically shaped screw races 37 and 39, respectively. Such walls then turn to angle inwardly at 41 and 43 and then turned back outwardly to form respective flat marginal flanges 45 and 47. The top wall 31 is formed near its opposite ends with socket mounting screw bores 70 (FIG. 3).

Figure 5:
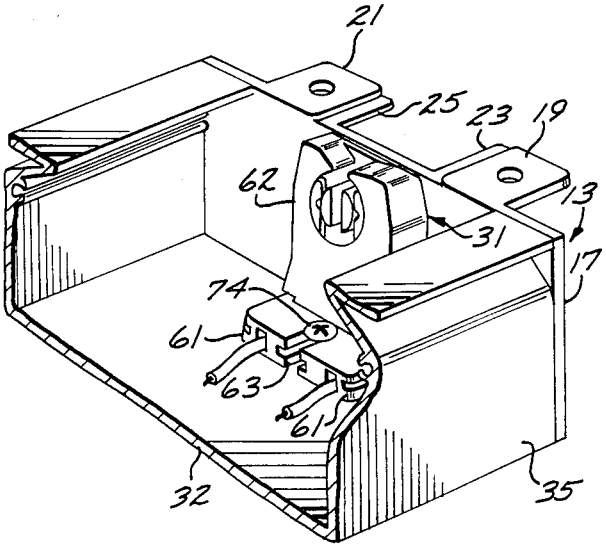
FIG. 5 is a perspective view similar to FIG. 3 but showing the light socket mounted within the housing itself.

Referring to FIGS. 4 and 5, the end caps 13 and 15 may be constructed of plastic and are formed to overlie the ends of the housing 11. Such end caps include end plates 51 formed at their opposite sides with through bores for receipt of mounting screws 53 and 55 received in the respective races 37 and 39. The end caps 13 are formed at their bottom sides with the longitudinally extending tabs 19 and 21. Such tabs 19 and 21 are formed medially with respective mounting bores 57 and 59 (FIG. 5) and are reduced in thickness on their proximate edges to form the respective confronting ribs 23 and 25 for receipt in the respective grooves 27 and 29 of the tube sockets 31 (FIGS. 2 and 3). The tabs form therebetween an open ended track such that the confronting edges of such tabs may be received in the grooves 27 and 29.

The sockets 31 may be constructed of any desirable electrically insulative material and are formed with confronting socket depressions mounting terminals for mating with the terminals of a fluorescent tube (not shown). The sockets 31 are typically L-shaped to form respective longitudinal bases 61 and upstanding legs 62. The bases are formed centrally with open ended notches 63 for, in one orientation, receiving mounting screws 74 (FIG. 5 . The opposite side of the upstanding legs 62 are formed with notches 64 and 66 (FIG. 2) for selective frictional receipt of the tongues 21 and 23 for a purpose which will be made apparent hereinafter.

Figure 1:
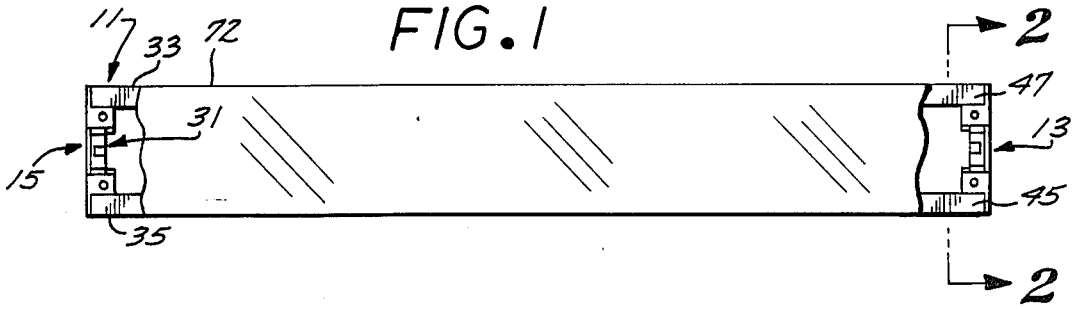
FIG. 1 is a bottom plan view of a light fixture embodying the present invention.

In operation it will be appreciated that the housing 11 may be extruded at the place of manufacture and the end caps 13 assembled thereto in a configuration dictated by the anticipated mounting configuration desired for the fixture. It will be further appreciated from the following description that the particular assembly may be easily completed or altered by the user to adapt the housing for either mounting in a recessed or flushed condition or in a projecting condition. Assuming the fixture is to be assembled for mounting in a non-recessed condition, the end caps 13 and 15 will be mounted to the housing 11 in the configuration shown in FIGS. 1–3 such that the tabs 19 and 21 extend longitudinally toward one another in the housing itself. It will be appreciated that such tabs are configured to be received in the space formed between the respective marginal flanges 45 and 47 of he housing (FIG. 2). In that configuration the mounting screws 53 and 55 are inserted throu h the bores in the end plates 17 and screwed into the respective races 37 and 39 to hold the caps in position.

Because of the danger of breakage, it is desirable to avoid shipping the fixtures with the sockets 31 in their extended position shown in FIG. 3. In this regard, the sockets 31 may easily be mounted to the end caps in their inverted position shown in FIG. 4 by merely fitting the grooves 64 and 66 over the respective tongues 23 and 25. The socket 31 will thus be held in position during shipping.

When the user then unpackages the fixture, the sockets 31 may be conveniently removed from the tongues 23 and 25, inverted, and reinserted in their projecting position with the tongues 23 and 25 received in the respective mounting grooves 27 and 29.

With the sockets 31 so installed, the electrical wiring may then be connected and the housing 11 conveniently mounted to the ceiling by inserting mounting screws in bores 70 formed in the top wall 32 thereof. A lens 72 (FIG. 1) may be then mounted on the flanges 45 and 47 behind the tube extending between the sockets 31 to thus shield the electrical wiring within the housing 11 and diffuse light from the fluorescent tube not shown).

For the flush mounting mode, the end caps 13 and 15 will be mounted in their positions reversed from that shown in FIG. 3 to thus orient the mounting tabs 19 and 21 projecting longitudinally outwardly of the housing 11 as shown in FIG. 5. In this configuration, the sockets 31 are mounted directly to the top wall 31 of the housing 13 by inserting a mounting screw 74 in the mounting slot 63 and screwing it through the mounting bores 70 in such top wall. A hole may be formed in the ceiling for receipt therein of the housing 11, the electrical wiring connected and such housing recessed in such hole with the tabs 19 and 21 at the opposite ends of such housing brought into contact with such ceiling. Mounting screws may then be inserted in the mounting holes 57 and 59 of the tabs 19 and 21 to secure the housing 11 in its flush position to the ceiling. A fluorescent tube (not shown) may then be installed with its opposite ends received in the sockets 31. The light is then ready for operation. The lens 72 may then be installed on the flanges 45 and 47 to diffuse the light from the fluorescent tube and to obscure the electrical wiring mounting on the top wall 32.

From the foregoing, it will apparent that the light fixture of the present invention is economical to manufacture and provides for convenient reversibility of the end caps thus minimizing the number of components which must be manufactured and inventoried for adapting the fixture for use in either a flush mounting or non-flush mounted condition. Assembly is relatively straightforward, thus enabling assembly and installation by even the most inexperienced user.

Various modifications and changes may be made with regard to the foregoing detailed description without departing from the spirit of the invention.

I claim:

1. A fluorescent light fixture comprising:

a channel shaped elongated housing formed with a top wall and a pair of oppositely disposed side walls terminating in opposite ends;

a pair of reversible end caps, said end caps each including an end plate and a pair of laterally spaced apart, longitudinally extending mounting tabs, said tabs being formed centrally with mounting bores and further being formed on their respective confronting sides with longitudinal tongues cooperating to define an open ended mounting track, said end plates being so sized and configured that they may be mounted in a first position with one side against a respective one of said ends of said housing with said tabs projecting longitudinally outwardly therefrom and, alternatively, be mounted in a second position with the opposite side overlying a respective one of said ends of said housing with said tabs projecting longitudinally inwardly and toward one another;

a pair of lamp sockets for selective receipt in said housing and each including a base for selectively abutting against said top wall, each of said sockets being formed in their respective opposite sides with grooves sized and arranged for selective frictional receipt of said tongues such that said sockets may be selectively slid into the respective tracks in the longitudinal direction to mount the respective sockets on the respective pairs of tabs;

socket mounting means for selectively mounting said bases to said top wall; and mounting means for mounting said end caps from the respective ends of said housing in said first or second positions whereby said end caps may be selectively mounted from said housing with said tabs projecting longitudinally outwardly therefrom with said mounting bores disposed exterior of said housing for ready access to said mounting bores or, in the alternative, may be mounted to said respective ends with said tabs projecting inwardly into said housing and said sockets fitted between said tabs with said tongues received in said respective grooves.

2. A fluroescent light fixture according to claim 1 wherein:

said bases are formed with longitudinal slots; and said socket mounting means include screws received in said respective slots for mounting said sockets to said top wall.

3. A fluorescent light fixture according to claim 1 wherein:

said pairs of tabs are reduced in thickness on their respective confronting sides to form said tongues.

4. A fluorescent light fixture according to claim 1 wherein:

said sockets are formed with upstanding legs disposed on said respective bases, said bases being formed in their opposite sides with outwardly opening storage slots extending parallel to the respective grooves and configured to frictionally receive said respective tongues whereby said sockets may be temporarily mounted on said end caps by slipping said storage slots over said tongues.

5. A fluroescent light fixture according to claim 2 wherein:

said sockets are formed with upstanding legs disposed on said respective bases, said bases being formed in their opposite sides with outwardly opening storage slots extending parallel to said respective grooves and configured to frictionally receive said respective tongues whereby said sockets may be temporarily mounted on said end caps by slipping said storage slots over said tongues.

6. A fluorescent light fixture according to claim 3 wherein:

said bases are formed with longitudinal slots; and said socket mounting means include screws received in said respective slots for mounting said sockets to said top wall.

* * * * *